US005528031A

United States Patent [19]

Franzen

[11] Patent Number: 5,528,031

[45] Date of Patent: Jun. 18, 1996

[54] COLLISIONALLY INDUCED DECOMPOSITION OF IONS IN NONLINEAR ION TRAPS

[75] Inventor: Jochen Franzen, Bremen, Germany

[73] Assignee: Bruker-Franzen Analytik GmbH, Bremen, Germany

[21] Appl. No.: 502,608

[22] Filed: Jul. 14, 1995

[30] Foreign Application Priority Data

Jul. 19, 1994 [DE] Germany ..... 44 25 384.2

[51] Int. Cl.[6] ..... H01J 49/42

[52] U.S. Cl. ..... 250/282; 250/290; 250/291

[58] Field of Search ..... 250/282, 281, 250/290, 291, 292, 293, 295

[56] References Cited

U.S. PATENT DOCUMENTS

| | | | |
|---|---|---|---|
| 4,736,101 | 4/1988 | Syka et al. | 250/292 |
| 4,761,545 | 8/1988 | Marshall et al. | 250/291 |
| 5,170,054 | 12/1992 | Franzen | 250/292 |
| 5,171,991 | 12/1992 | Johnson et al. | 250/282 |
| 5,198,665 | 3/1993 | Wells | 250/291 |
| 5,352,890 | 10/1994 | Johnson et al. | 250/282 |

FOREIGN PATENT DOCUMENTS

| | | |
|---|---|---|
| 0202943 | 5/1986 | European Pat. Off. . |
| 0580986 | 5/1993 | European Pat. Off. . |
| 0575777 | 5/1993 | European Pat. Off. . |
| 0643415 | 9/1994 | European Pat. Off. . |
| WO93/05533 | 8/1992 | WIPO . |

OTHER PUBLICATIONS

*Non–Resonance Excitation and Ejection in Ion Trap*, 41th ASMS Conf. Mass Spectrom. & Allied Topics, Wang et al., 1993, pp. 463a–463b.

*Primary Examiner*—Jack I. Berman
*Assistant Examiner*—Kiet T. Nguyen

[57] ABSTRACT

A method of fragmenting ions in conventional nonlinear ion traps using collisions of ions with molecules of a collison gas with excitation of the secular oscillations of the ions. A mixture of frequencies for resonant excitation, with a frequency limit which prevents the ions from being excited beyond the maximum oscillation amplitude between the end caps.

10 Claims, 2 Drawing Sheets

COLLISIONALLY INDUCED DECOMPOSITION OF IONS IN NONLINEAR ION TRAPS

The invention relates to a method of fragmenting ions in conventional nonlinear ion traps by collisions of ions with molecules of a collision gas with excitation of the axial secular ion oscillations.

BACKGROUND OF THE INVENTION

To analyze the structure of ions, to clearly identify substances, or even to examine complex substance mixtures, the method of "daughter spectra" acquisition of selected "parent ions" is frequently applied. Daughter spectra are mass spectra of charged fragments of selected parent ions from the primary spectrum of the substance or the substance mixture.

Selection of the parent ions relates to their mass-to-charge ratio, or more precisely, to their nominal mass-to-charge ratio, calculated from their nominal mass, i.e. a mass number which only takes into account the number of protons and neutrons in the molecule and not the precise isotope masses.

Consequently, parent ions are selected for the daughter spectrum which all have the same nominal mass. These ions will be referred to as parent ions, without regard whether these parent ions are of the same type, i.e. have the same total formula and the same ionic structure, or not.

In a first step during the analysis, the parent ions are isolated in the ion trap. This means that the ions of this nominal mass are kept stored and all the other types of ions are removed from the ion trap. This step of isolation is not always necessary, for example, when there are no ions of smaller masses in the trap. There exists a number of well-known methods for this isolation process for the parent ions.

In a second step, the parent ions are dissociated into partially charged and partially uncharged fragments by pumping adequate energy into the inner oscillation system of the molecule. This process is generally called fragmentation or, more specific for a special method, collisionally induced decomposition (CID). The charged fragments form the daughter ions.

In the final step, abundancies and masses of the charged fragment ions are determined by measurement. These pairs of values, abundancies and masses of the fragment ions, form the daughter ion spectrum, from which information about the ionic structure, identity or mixture of the parent ions can be obtained.

Structural analyses is of interest in many different investigations: it reveals, for instance, the brutto formula of the original substance, the functional sub-group composition of a molecule, particularly the amino acid sequence of peptides, proteins, proteoglycanes, or nucleotides; and last but not least the folding structure of large biomolecules if these biomolecules are subjected to certain surface reactions like deuterization.

Fragmentation of an ion takes place if sufficient "inner energy" is imparted on the ion, i.e. energy which is pumped into the inner structure of the molecule. For fragmentation there are two basically different methods of imparting energy on the ion:

1. Fragmentation by photon irradiation. This method is very efficient and provides good, frequently very characteristic fragmentation results; however, it calls for the use of strong light sources, preferably lasers. These light sources constitute an expensive feature which is not normally found on an ion trap. This type of fragmentation will not be dealt with here.
2. Fragmentation by collisions with molecules of a collision gas (CID) in the ion trap. This collisional fragmentation is simple and requires no additional experimental equipment apart from what is already available to operate ion traps.

Collisionally induced decomposition of the parent ions begins when the secular oscillation of the ions in the storage field is excited by resonance with an RF field generated by applying an RF dipole voltage across the end caps, as described in U.S. Pat. No. 4,736,101 (Syka, Louris, Kelley, Stafford and Reynolds). The ions absorb energy in the dipole field and continuously enlarge their oscillation amplitudes. Because the ion trap usually contains a collision gas to damp the ionic movement, many collisions with the collision gas occur. The collision gas is normally controlled in such a way that one collision takes place in five to twenty ion oscillations. This corresponds to a collision gas pressure somewhere in the range between $10^{-4}$ and $10^{-2}$ millibar. With correct control of collision gas pressure and dipole voltage the oscillation amplitude can be just damped enough by the numerous collisions with the collision gas so that the ions do not hit the end caps. This is, however, a balance difficult to maintain.

The oscillating parent ions absorb several discrete portions of energy in subsequent collisions. These portions of energy are stored in the inner oscillation states of the ion. When a threshold value for the inner energy is exceeded, fragmentation can occur. The ions can therefore decompose although the energy taken up in an individual collision is not sufficiently high for fragmentation.

On the other hand, the absorbed portions of energy cannot be infinitely small. Due to the quantum structure of the energy levels of the ions' inner oscillation system, only discrete quantities of energy above a threshold can be absorbed. All collisions, the energy transfer of which would not be adequate to change the quantum level, behave like fully elastic collisions which take place without any energy transfer into the molecule. Only through the existence of this lower threshold value is it possible to store molecular ions in an ion trap for virtually any length of time without decomposition although the trap contains a collision gas which, due to the usual heating of the ion trap, is between room temperature and about 250° C.

All the ion traps used as mass spectrometers nowadays deviate from pure quadrupole traps in order to achieve good levels of mass resolution for ion ejection during scanning. Usually weak higher even multipole fields (octopole field, dodecapole field, etc) are superposed on the pure quadrupole field. Superposition is caused simply by designing the shape of the electrode structure different from that of a pure quadrupole ion trap. Superposition with higher multipole fields results in field along the axis of the rotationally symmetric ion trap which increases not simply linearly from the center outward to the end caps, as with a pure quadrupole field, but increases disproportionally. An octopole field provides a field component which rises cubically and a dodecapole field provides a component which increases by the fifth power. The resulting ion traps, therefore, are called nonlinear ion traps.

The process of fragmentation, however, is thus impaired. If an ion increases its oscillation amplitude by resonance with the dipole field, the ion is now subjected to a retroactive force which no longer increases proportionally to the distance from the center. Consequently we no longer have a purely harmonic oscillation which is characterized by a frequency which is always constant irrespective of the oscillation amplitude. The retroactive force which increases more than proportional by the superimposed multipole fields, causes a change in oscillation frequency with increasing amplitude. The oscillation becomes faster with larger amplitudes.

With conventional ion traps having approximately 2% octopole field, measured as the additive field strength of the octopole field at the summit of the end caps compared with the field strength of the quadrupole field, the frequency shift is quite substancial. The frequency shift amounts to several percent if the ion oscillates just up to the end cap electrodes. Measured on the mass scale, the shift also accounts for several percent, which means several mass units for an ion of 100 to 200 atomic mass units. To express it more exactly: the frequency of an ion oscillating far up to the end caps equals the frequency of an weakly oscillating ion with a mass which differs by several mass units.

The ion to be fragmented therefore falls out of resonance with the applied RF dipole voltage when its oscillation amplitude increases. Further excitation of its oscillation is no longer possible. The fragmentation process is therefore very difficult.

EP 0 580 986 A1 proposes an improvement of the collisionally induced decomposition by modulation of the storage quadrupole RF voltage at the rate of the secular frequency. This method, however, underlies the same principles of frequency shift and is of no help here.

The usual method to overcome the problem with frequency shifts is a slightly nonresonant excitation of the basic oscillation of the parent ions on the flank of the resonance curve. This is achieved by slightly detuning the excitation frequency and increasing the excitation voltage. When the correct flank is chosen, and the oscillation amplitude starts to increase, the frequency of the ions moves by itself into the resonance maximum. If the amplitude then increases further, the frequency moves out of the resonance, the ions no longer resonate. Since the width of the resonance curve, however, is very small compared to the shift in secular oscillation frequency, this balancing act is usually quite unsatisfactory. M. Wang and G. Wells ("Non-Resonance Excitation and Ejection in Ion Traps", 41st ASMS Conf. Mass Spectrom. & Allied Topics, p.463, 1993) employ, for these reasons, a completely different method of exciting the ionic oscillation by superimposing low frequency DC pulses. However, this method has the disadvantage of not only acting on the parent ions to be fragmented but on all the ions in the ion trap, particularly including the daughter ions formed.

It is the task of the invention to find a method by which the secular oscillations of the parent ions can be excited in such a way that, irrespective of the pressure of the collision gas, they have an optimal amplitude for collisionally induced decomposition. On the other hand, they have to be retained from hitting the end caps, thereby being discharged and thus eliminated from the process.

SUMMARY OF THE INVENTION

The invention is based on resonant excitation of the secular oscillations of the parent ions by applying a mixture of exciting frequencies to the ion trap electrodes instead of a single frequency. If the frequency differences are smaller than the half-width of the resonance curve, the ions always experience resonance of their secular oscillation by a component of the mixture, irrespective of their oscillation amplitude.

It is the basic idea of the invention to have the frequency mixture terminate at an upper frequency limit. The frequency limit is chosen such that ions oscillating with this frequency just do not touch the end cap electrodes. Ions with wide amplitudes thus are no longer subjected to further resonance.

As a result the ion systematically falls out of resonance when its oscillation amplitude has become adequate for energy absorption by collisions and immediately resumes resonance again when its oscillation amplitude, and hence its oscillation frequency, has become smaller again due to energy losses by collisions.

Expressed more accurately, the amplitude profile of the frequency mixture must terminate lower than the above-mentioned frequency limit by half the width of the resonance curve. However, since the resonance curve has a width which is small compared with the frequency variations observed here, this detail is of minor importance. Any experimental calibration of the fragmentation process will automatically correct for this small effect.

There are several choices for the amplitude profile of the frequency mixture. In a first approach, the amplitude function can be made constant, i.e. of equal magnitude up to the frequency limit. However, to avoid an overshooting of the ion oscillation, it is more favorable to configure the frequency mixture so that the frequency components which correspond to the maximum oscillation amplitude have a lower voltage and therefore excite less.

The frequency mixture can thus have a voltage profile which has a large voltage for the basic secular oscillation at very low amplitudes, imparting considerable acceleration on the ions, but at higher frequencies, which are assumed at greater amplitudes, it drops to lower levels of voltage. At the frequency corresponding to a maximum required oscillation amplitude, the voltage must reach zero so that the ions cannot be accelerated beyond this maximum amplitude. The amplitude profile can assume the form of a descending straight line. It is, however, most advantageous for the amplitude profile to take the form of a horizontal parabola, whereby the summit is at the frequency limit. The amplitude decreases towards the frequency limit proportional to the square root of the frequency difference with the frequency limit.

When examining the behavior of an ion in this frequency mixture more closely, it will be observed that the ion cannot execute a simple sine-shaped oscillation with an amplitude which is constantly increasing. The phase relations in the frequency mixture, which are in fact constantly changing in time, prevent this. Due to the constantly changing phase relations the ion will perform oscillations in a complicated and irregular wiggle alternating between accelerations and decelerations. The details of these movements are of no interest here. At any rate, the peaks of these wiggles cannot become so great that the ions hit the end caps. As soon as the ion, approximately in a wiggle bulge, oscillates at its required maximum amplitude, its secular frequency is automatically at the border of the frequency mixture and the ion is not subjected to further acceleration. In the borderline case of this undisturbed oscillation at the frequency limit of the mixture a relatively clean sine-wave oscillation will then occur until the oscillation is disturbed again by a decelerating collision. The collision gas usually has adequate pressure so that a collision takes place about every ten oscillations on a statistical average.

This way of exciting the secular oscillations of the ions for fragmentation offers further advantages. Particularly by chosing a declining amplitude function it can be configured so that the fragmentation becomes largely independent of the number of collisions in the collision gas, and therefore of the "gas friction" or viscosity. In particular, the pressure of the collision gas and the collisional cross-section of the various parent ions do no longer play a determining role.

Furthermore, the amplitude profile can be kept identical for all the parent ions of the same nominal mass because all the ions suffer the same change in frequency according to amplitude. If there are different types of parent ions with slightly different masses but the same nominal mass, their masses will at most differ by a few tenths of a mass unit, which is of no consequence for energy absorption during fragmentation.

In particular the height of the amplitude profile for parent ions of the same mass can also always be kept the same because its optimal magnitude is no longer determined by the individual collisional cross-sections and the pressure of the collision gas. Hitherto, this parameter was the most critical one, and had to be experimentally determined for each ion species separately. Consequently the fragmentation parameters, which had so far to be varied, i.e. fragmentation time, voltage (field amplitude) and frequency, are reduced to only two parameters: time and frequency. These parameters will be shortly discussed here.

Already in the past, the fragmentation time was kept constant for all ions to be fragmented because varying it only played a subordinate role. Fragmentation essentially takes place according to the laws of exponential decomposition, after a certain pumping time. When the main quantity of parent ions has been fragmented, extension of fragmentation produces no significant gain. Fragmentation times amount generally to values between 20 and 50 milliseconds, so fragmentation takes a few thousand secular oscillations, whereby a few hundred collisions take place. So the fragmentation time can be kept constant.

The frequency was the other most critical parameter to be set. It is made much less critical by the new method. Due to the dependence of amplitude on frequency, measured on the mass scale, it only needs to be accurate to a few tenths of a mass unit in order to prevent the ions from hitting the end caps. It is therefore sufficient to merely know the nominal mass of the ions and not the exact ion mass calculated from the isotope masses.

Frequency can also be kept constant by always fragmenting the parent ions at the same point on the stability diagram. The parent ions only must be transformed to that point on the stability diagram by setting the storage voltage amplitude accordingly. Setting the storage voltage amplitude can be very easily performed via the normal mass calibration function which has to be determined for any ion trap.

The method of this invention, therefore, is a big step forwards to a more general fragmentation procedure. For the first time an automatic fragmentation of unknown ions based on their nominal masses becomes possible irrespective of the individual characteristics of the ions. So far automation has always failed because the setting parameters had to be optimized individually for each ion species.

The diagram shows, along the same frequency axis, an amplitude profile of a frequency mixture which can be used for fragmentation. From a maximum amplitude which ensures good resonant excitation of the ions in their basic oscillation at small amplitudes it declines towards the frequency limit of the mixture. The frequency limit is selected so that it is smaller than the oscillation frequency of the ions at their maximum oscillation amplitude between the end caps. For this reason the ions cannot be accelerated by the frequency mixture up to the end caps. The diagram does not include the half-width of the resonance profile, which is only about 0.5 kHz and therefore is of little consequence.

DESCRIPTION OF THE PREFERRED EMBODIMENTS

Figure 1:
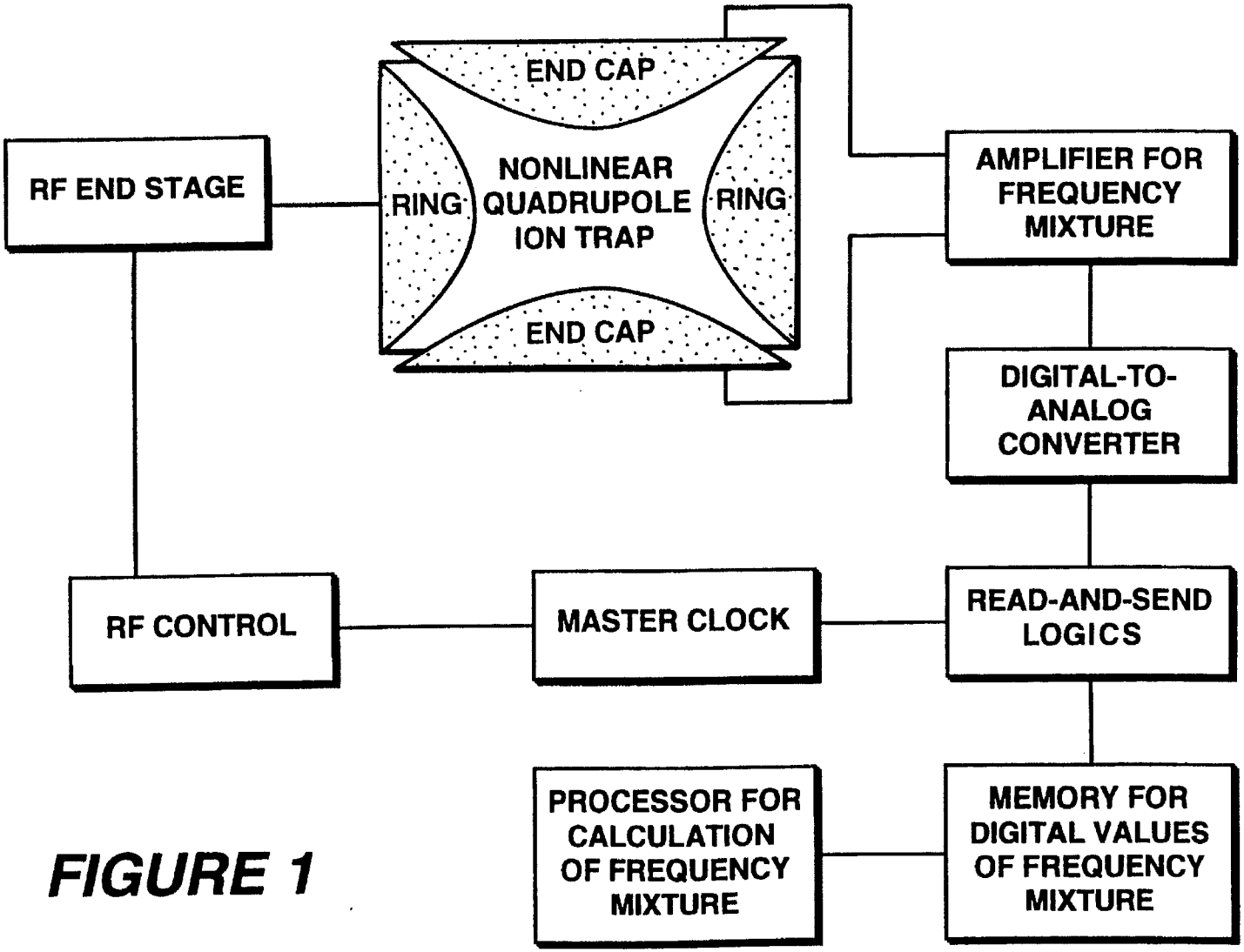
FIG. 1 shows a schematic of digital generation of frequency mixtures, as used in favorable embodiments of the ion trap for fragmentation. Digital generation of frequency mixtures is already included in some ion traps for MS/MS operation because it can also be advantageously used to isolate the ions.

A particularly favorable embodiment comprises digital generation of the frequency mixture, especially since the device for digitally generating the frequency mixture is often already installed in the ion trap spectrometer to isolate the parent ions. FIG. 1 shows a schematic for generating the frequency mixture digitally. The digital generation may use calculations by discrete superposition of frequencies with the wanted amplitude profile, or by fast Fourier transform (FFT) methods.

Fragmentation of the parent ions favorably always takes place at the same point on the stability diagram, for instance at a point which corresponds to four times the mass at the border of the stability diagram. Then all the parent ions which are larger than one quarter of the parent mass can be captured during fragmentation.

For evaporable substances, the molecular weights of which are generally less than 300 atomic mass units, the probability that all the parent ions formed are also captured is very high. Smaller fragments generally form very stable neutral particles which are only seldom ionized, for energetic reasons.

For very large molecules, e.g. proteins, even smaller fragments are of interest. However, the farther away one is from the stability limit the more difficult it will be to perform fragmentation because here the ion trap's pseudo potential well in which the particles can oscillate becomes increasingly flat. In a flat potential well the ions can only oscillate slowly so energy transfer per collision is very small. Hence, here too such a limitation to a fixed fragmentation point on the stability diagram would seem advisable.

Although the potential well at this point is already very flat, which makes fragmentation more difficult, it is not so flat that fragmentation is no longer possible. Selection of the fragmentation point on the stability diagram will always have to be a compromise.

For fragmentation at the selection point the data sequence of the amplitude values for digital generation of the frequency mixture only needs to be calculated once. This frequency mixture can then be used for all the parent ions, irrespective of their mass. If fragmentation time is kept constant, the amplitude for the storage RF is the only parameter which needs setting. This is set via the calibration function of the mass scale and basically determines the mass at the border of the stability diagram and therefore also the point of parent mass on the stability diagram.

Calculation of the data sequence for generating the frequency mixture can take place by mathematical superposition of discrete sine-wave curves with appropriately selected amplitudes, frequencies, and phases. The frequency spacing should not exceed half a resonance amplitude. The phases of the frequency mixture should have a nonlinear shift in relation to one another at a fixed point in time, for example at the start of fragmentation, in order to eliminate undesirable amplitude peaks of superimposition (see U.S. Pat. No. 4,761,545).

Calculation can be very favorably performed with the aid of Fourier transformations. The amplitude profile of the frequencies in the frequency area is directly transferred to a data sequence of the amplitude values in the time area.

Figure 2:
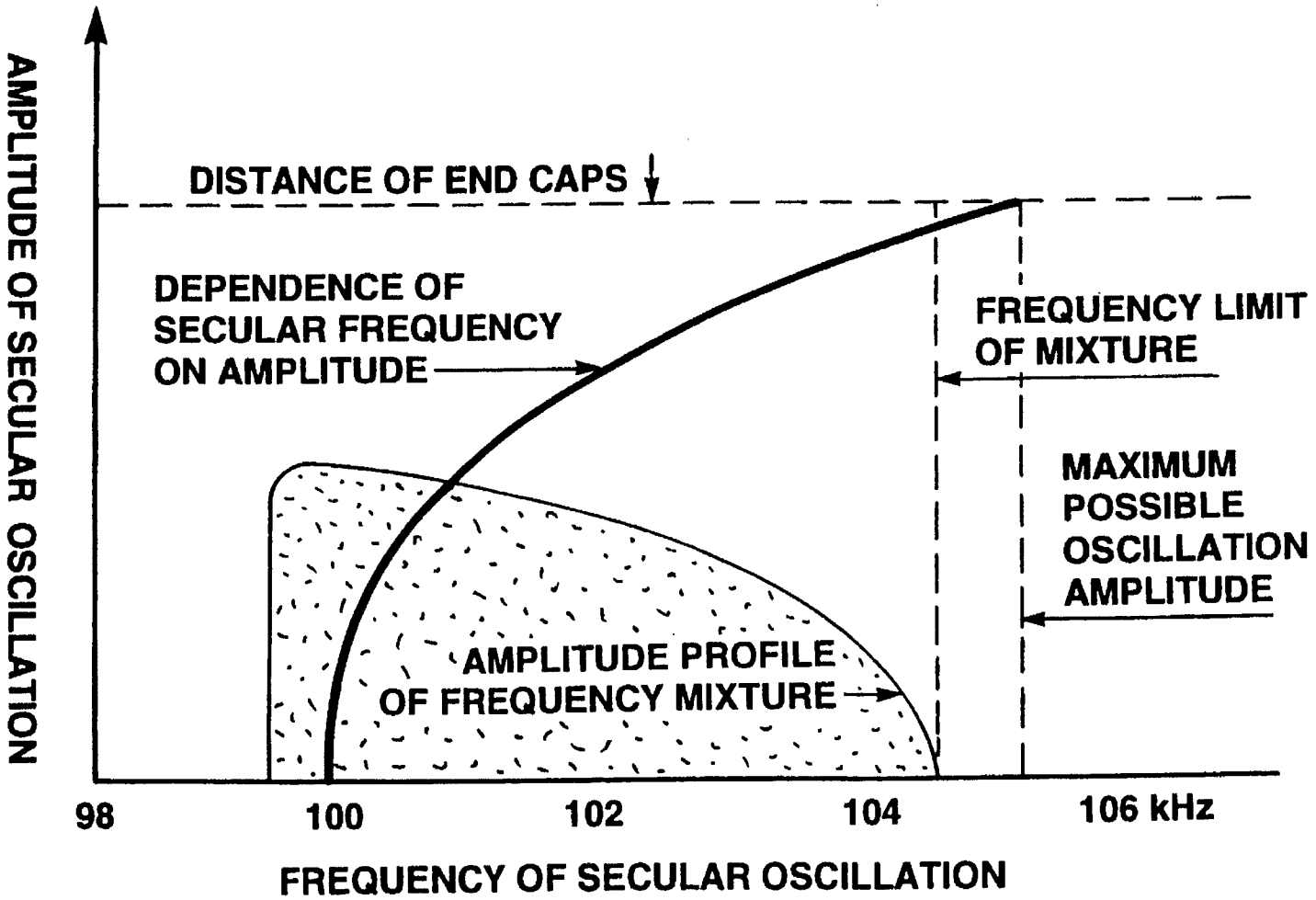
FIG. 2 shows the dependence of the secular frequency on the oscillation amplitude of ions on a frequency scale. The change ranges from a basic frequency of 100 kHz for small oscillation amplitudes up to approx. 105 kHz for an oscillation amplitude where the ions hit the end caps of the ion trap.

For a conventional ion trap with an approx. 2% octopole field and a storage frequency of 1 MHz, an ion in the vicinity of the above-described point on the stability diagram has a secular frequency of approx. 100 kHz. For fragmentation at this favorable point we set the storage RF amplitude such that the ions of interest oscillate at exactly 100 kHz, measured at a very low oscillation amplitude. The frequency shift up to an amplitude which is just short of hitting the end caps is about 5 kHz in this case. Consequently, the frequency mixture should range from about 99.5 to 104.5 kHz, in frequency steps of about 0.5 kHz, with an amplitude function which, for an ion of mass 100μ, experiences a parabolic decline from about 2 volts at 100 kHz to 0 volts at 104.5 kHz, as shown in FIG. 2.

If in the particular ion trap post amplification of the frequency mixture is possible under digital control, as is frequently the case, it is particularly advantageous to set post amplification so that it is proportional to the mass of the parent ions to be fragmented. Excitation voltage then has a fixed ratio with storage RF voltage.

If, in addition to dipolar excitation with a frequency mixture across the end cap electrodes, a quadrupolar excitation is also used with a second frequency mixture between ring and end caps, one can favorably adjust the amplitude profiles relatively to each other so that adjacent ions (for example a daughter ion which has to be trapped by splitting off $H_2$ only two masses below the parent ion) are disturbed as little as possible. The dipole field should handle acceleration at small oscillation amplitudes and the quadrupole field, which has no effect near the center of the trap, should handle acceleration at large amplitudes.

I claim:

1. Method of collisionally induced fragmentation of parent ions inside a quadrupole RF ion trap with superimposed even multipole fields comprising the following steps:

(a) filling the ion trap with collision gas at pressures between $10^{-4}$ and $10^{-2}$ millibar, (b) storing parent ions of a selected mass-to-charge ratio in the ion trap, and (c) resonantly exciting the oscillation of the parent ions by application of a mixture of high frequency voltages across end cap electrodes of the ion trap with frequencies in a narrow frequency range, whereby the frequencies cover the basic secular oscillation frequency of the parent ions, and range up to a limiting frequency which is selected such that parent ions excited by this frequency do not hit the end cap electrodes of the ion trap.

2. Method as in claim 1, whereby the frequency mixture is generated by superposition of voltages with discretely different frequencies, the differences of subsequent frequencies being smaller than the width of the resonance curve of the parent ions to be fragmented.

3. Method as in claim 2, whereby the starting phases of subsequent frequencies have a phase shift which increases nonlinearly.

4. Method as in claim 2, whereby the frequency mixture is generated by digital means.

5. Method as in claim 4, whereby the frequency mixture is generated by fast Fourier transform methods.

6. Method as in claim 1, whereby the voltage amplitudes of the frequencies in the frequency range up to the limiting frequency are constant.

7. Method as in claim 1, whereby the voltage amplitudes in the frequency range decline towards the limiting frequency.

8. Method as in claim 7, whereby the voltage amplitudes show a linear decline.

9. Method as in claim 7, whereby the amplitudes show a decline proportional to the square root of the distance to the limiting frequency.

10. Method as claim 1, whereby the voltage of the frequency mixture, for different parent ions to be fragmented in different analysis runs, is changed proportional to the mass of the parent ions.

* * * * *